US008519895B2

(12) United States Patent
Cviko

(10) Patent No.: US 8,519,895 B2
(45) Date of Patent: Aug. 27, 2013

(54) KEYS AND KEYLINES USED FOR ANTENNA PURPOSES

(75) Inventor: Mirsad Cviko, Malmö (SE)

(73) Assignee: Nokia Corporation, Espoo (FI)

( * ) Notice: Subject to any disclaimer, the term of this patent is extended or adjusted under 35 U.S.C. 154(b) by 559 days.

(21) Appl. No.: 12/700,899

(22) Filed: Feb. 5, 2010

(65) Prior Publication Data

US 2011/0193749 A1 Aug. 11, 2011

(51) Int. Cl.
*H01Q 1/24* (2006.01)

(52) U.S. Cl.
USPC ..... 343/702; 343/850

(58) Field of Classification Search
USPC ..... 343/702, 850, 853, 860
See application file for complete search history.

(56) References Cited

U.S. PATENT DOCUMENTS

| | | | | |
|---|---|---|---|---|
| 4,462,009 | A * | 7/1984 | Landt et al. | 333/17.1 |
| 5,363,402 | A * | 11/1994 | Harmon | 375/132 |
| 6,061,025 | A * | 5/2000 | Jackson et al. | 343/700 MS |
| 6,812,898 | B2 | 11/2004 | Doub et al. | 343/702 |
| 7,383,067 | B2 | 6/2008 | Phillips et al. | 455/575.1 |
| 2007/0210971 | A1 | 9/2007 | Hsu | 343/702 |
| 2009/0251384 | A1 | 10/2009 | Ligtenberg et al. | 343/904 |
| 2010/0267421 | A1 | 10/2010 | Rofougaran | 455/566 |

FOREIGN PATENT DOCUMENTS

| | | | |
|---|---|---|---|
| CN | 1893703 | A | 1/2007 |
| EP | 1 544 943 | A1 | 6/2005 |
| EP | 1 583 254 | A1 | 10/2005 |
| EP | 1 686 648 | B1 | 4/2008 |
| EP | 1 748 515 | B1 | 9/2008 |
| KP | 20090081278 | A | 7/2009 |
| WO | WO 2008/059315 | A1 | 5/2008 |
| WO | WO 2009/001158 | A1 | 12/2008 |

* cited by examiner

*Primary Examiner* — Hoanganh Le
(74) *Attorney, Agent, or Firm* — Harrington & Smith

(57) ABSTRACT

An apparatus has a data input device arrangement and an electrical circuit. The data input device arrangement includes at least one user input key and at least two keylines configured to provide a data input to the apparatus. The electrical circuit has at least a first electrically conductive component configured to decouple the data input device arrangement at a predetermined radio frequency band to provide an antenna. In an embodiment the predetermined frequency is an operational frequency of the provided antenna. In various embodiments when the data input device is decoupled one of the keylines provides an antenna radiator component, and in another it provides an antenna parasitic short to ground. In various embodiments the first electrically conductive component exhibits a high impedance at the predetermined radio frequency band, and in another it is a notch filter which passes the predetermined radio frequency band.

23 Claims, 12 Drawing Sheets

KEYS AND KEYLINES USED FOR ANTENNA PURPOSES

TECHNICAL FIELD

The example and non-limiting embodiments of this invention relate generally to wireless communication systems, methods, devices and computer programs and, more specifically, relate to an antenna made from electrical components of a keypad.

BACKGROUND

For many years portable electronic communication devices have become more multi-functional. Particularly mobile phones but also some others such as laptop and palmtop computers have expanded their original voice communication function to include Internet access, Bluetooth coupling, GPS (global positioning system), FM radio, RFID (radio frequency identification) sensing, secure data storage, and the like. Many commonly available mobile terminals are also multi-radio devices, which have disparate cellular radios and antennas so users can readily find an operating network in any of numerous countries they may travel. Each of these radios, whether cellular, Bluetooth, WLAN (wireless local area network) or the like, require an antenna particularly adapted for the requisite frequency band.

Another obvious trend in mobile communication devices is size; users want mobile phones that have greater capabilities but in a smaller overall package. This causes difficulty in arranging the physical placement of antennas for the various radios within the terminal housing, since that crowded electrical environment leaves few locations for antenna placement. Often a single antenna radiator element may be tuned to cover two or more radio frequency bands, but multiple antennas are still the norm for most mobile terminals given that most include several of the disparate radios listed above. Antenna placement is critical to alleviate parasitic coupling and to assure a reasonable gain at the desired bandwidth, and to meet other performance metrics such as standing wave ratio SWR.

Particularly antennas for Bluetooth frequencies have been disposed in the physical area of the mobile terminal keypad. See for example International Patent Publication No. WO 2008/059315 entitled "Positioning Conductive Component Adjacent an Antenna" by Nokia Corp. (published 22 May 2008), in which a key dome, adjacent within about 10 mm to an antenna, is decoupled by an inductor at operational frequencies of the antenna. But the keypad area is quite crowded electrically and even this 10 mm spacing becomes restrictive to the circuit designer seeking to integrate antennas into the overall mobile terminal. What is needed in the art is a more adaptable antenna solution that does not so restrict the circuit designer's options, at least for one antenna operating in one band and optimally for antennas operating across multiple bands.

Other related teachings include the following references:

- US 2009/0251384, in which radio-frequency transceivers transmit and receive signals using key antennas;
- WO 09/01158, in which the electrical length of the ground plane changes depending on an interconnecting mechanism configuration;
- U.S. Pat. No. 7,383,067, in which a pattern of conductive traces forming an antenna circuit is positioned in a lower housing portion with keyboard circuitry;

SUMMARY

In one example embodiment of the invention there is provided an apparatus comprising a data input device arrangement and an electrical circuit. The data input device arrangement comprises at least one user input key and at least two keylines configured to provide a data input to the apparatus. The electrical circuit comprises at least a first electrically conductive component configured to decouple the data input device arrangement at a predetermined radio frequency band to provide an antenna.

In another example embodiment of the invention there is provided a method comprising: providing a data input device arrangement comprising at least one user input key and at least two keylines configured to provide a data input to the apparatus; and adapting the data input device arrangement with an electrical circuit comprising at least a first electrically conductive component that is configured to decouple the data input device arrangement at a predetermined radio frequency band to provide an antenna.

BRIEF DESCRIPTION OF THE DRAWINGS

FIGS. 6C-1 through 6C-3 illustrate a further host apparatus having various other exemplary embodiments of the invention.

DETAILED DESCRIPTION

In the given example embodiment of the invention, one or more keys of the user interface keypad has functionality for both data input and for RF antenna transmission and/or reception. This is achieved by modifying the keypad arrangement so that the data input function remains working, while adding the functionality of the antenna at the operational radio frequency (RF) bands. This is done in the exemplary embodiments detailed below by disposing suitable decoupling components in specific locations of the conductive keylines. Whereas the prior art keypad is isolated from the antenna at operational frequencies (see for example WO 2008/059315 noted in background above), exemplary embodiments of the invention use the keypad itself as an element of the antenna, either a radiator element or a parasitic coupling element as will be detailed further.

Figure 1B:
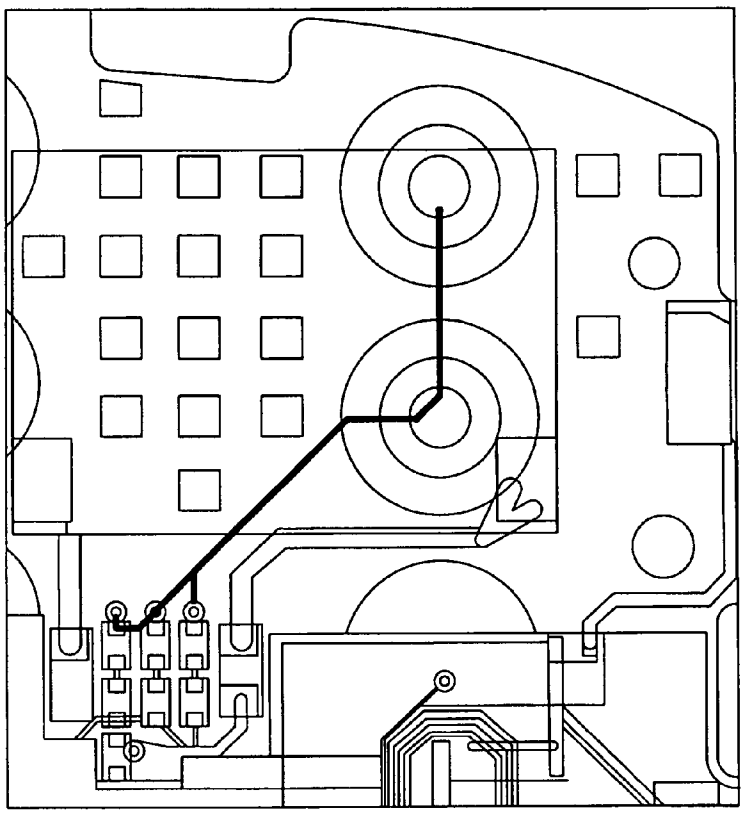
FIG. 1B PRIOR ART
FIGS. 1A-B are prior art schematic diagrams of a prior art user interface key arranged for decoupling at two radio-frequency bands.
Figure 1A:
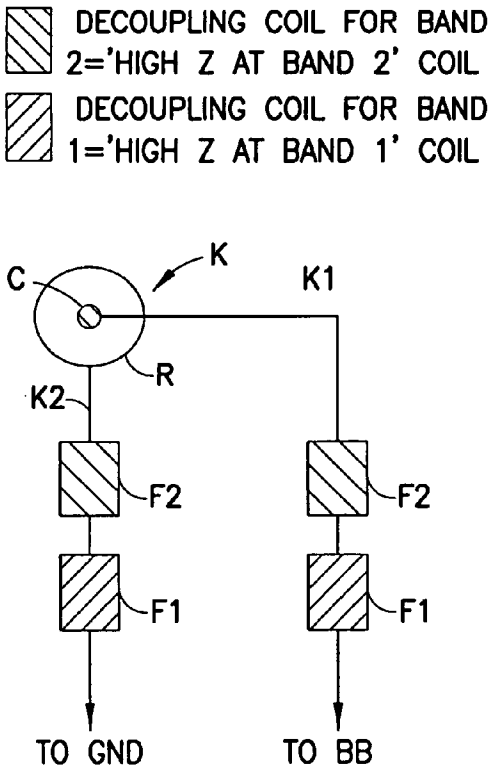
FIG. 1A PRIOR ART

First is described a conventional arrangement of a key as shown at FIGS. 1A-B. The key may be one of an array arranged for receiving user inputs, such as one or more keys of a QWERTY keyboard on a laptop or palmtop computer or on certain mobile terminals (for example, Nokia N97 and N900). Or the key may be one or more alphanumeric keys on a standard mobile phone keypad having numbers 0 though 9 and a few other characters, or it may be a soft key whose function is indicated by a changing screen identifier adjacent to the key.

At FIG. 1A there is an expanded schematic diagram of a key K with keyline K2 to the key ring R and keyline K1 from a centerpoint C of the key K. Each of the keylines K1 and K2 pass through two decouplers F1 and F2, which are decoupling inductors for different RF bands. In other example embodiments the two decouplers F1 and F2 may comprise more than one inductor per filter, and may additionally comprise other components typically used for filtering, for example, capacitors. By increasing the complexity of the circuit topology of the filters F1, F2 it may be possible to provide different filter characteristics to provide better filtering with respect to frequency. For example, the pass or stop band impedance responses (S-parameters: S11 or S22) may have sharper 'knees' so that a sharper frequency response is provided. Filters F1 show a high impedance to RF band 1 and block signals at that frequency and filters F2 show a high impedance at RF band 2 and block signals at that frequency. By example keyline K1 passes to a baseband BB processor chip and keyline K2 is coupled to a reference voltage (ground). The location of the K2 reference voltage may or may not be at the BB chip itself. When a user depresses the center of the key K, a connection is made between the centerpoint C and the ring R, closing the circuit with ground on keyline K2 and signaling the BB chip on keyline K1 that a user input has been entered at the key K.

FIG. 1B is a schematic view of a portion of the fuller keymat on which the individual key K of FIG. 1A is taken. Typically two keys are connected as shown, and the K1 and K2 keylines are close together. The keymat or substrate on which the conductive traces which form the key (centerpoint and ring) are made of a RF low loss material. A surface of the keys may also be made from or coated with such a RF low loss material. This makes the conductive keylines and the conductive traces which form the key ideal for use as an antenna in their own right, which opens up many more options for the circuit designer to place a Bluetooth antenna in the keypad area. While these examples use a Bluetooth antenna as a specific embodiment, the designer may also use these teachings for other antennas, and not limited to, such as for example GPS, WLAN, diversity antennas, antennas used for cellular bands (for example, extended global system for mobile communications EGSM, wideband code division multiple access WCDMA), and also for other antenna elements such as parasitic elements and neutralization lines.

Figure 2:
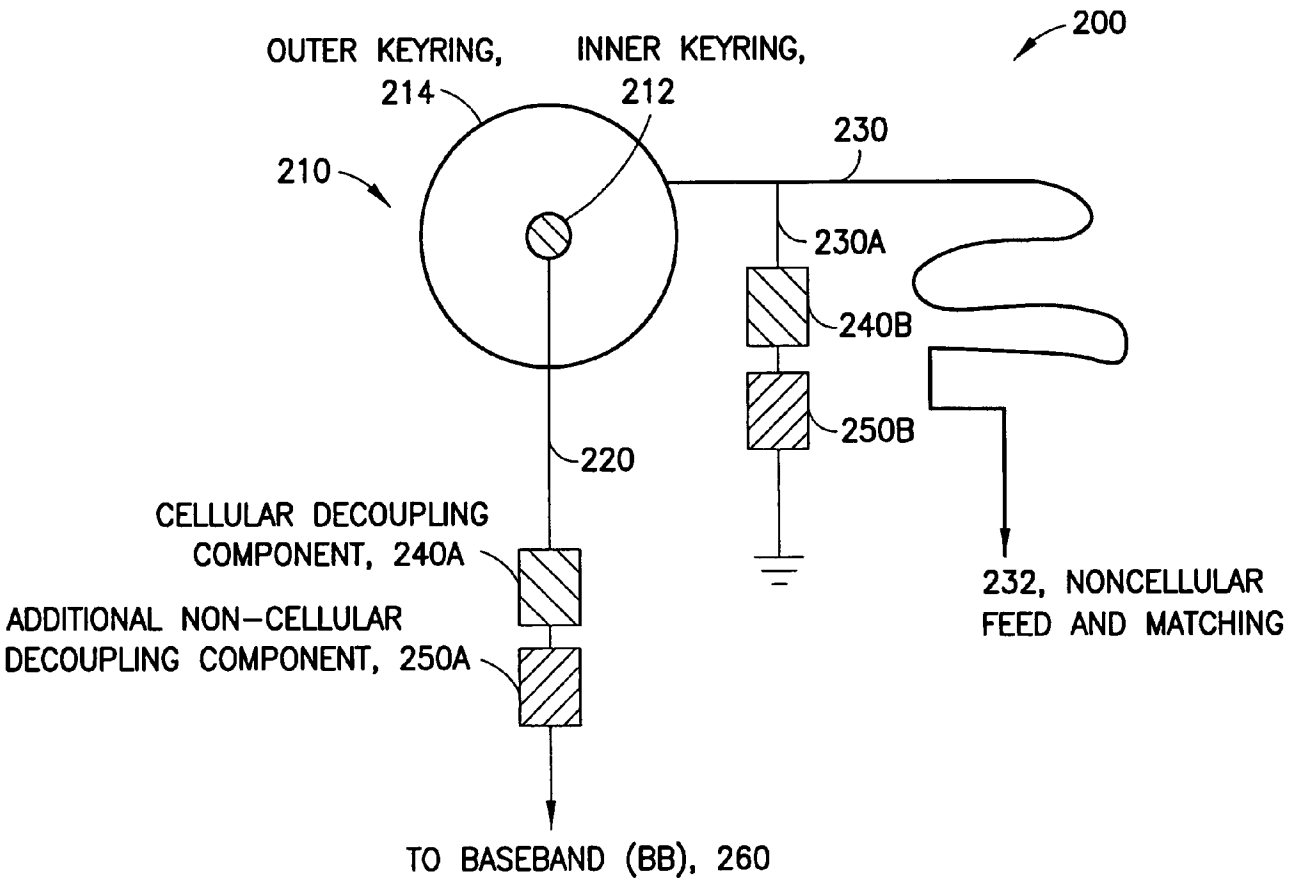
FIG. 2 is a schematic diagram of a key with dual functionality as data entry and antenna, according to an embodiment of the invention.

FIG. 2 illustrates an exemplary embodiment of the invention. An apparatus 200 has a user input key 210 and at least two keylines 220, 230, which may be implemented as conductive traces on the keymat for example. The first keyline 220 is in the position of keyline K1 shown at FIG. 1A and returns to the baseband processor as in FIG. 1A for registering a user input at the key 210 according to conventional key operation. Like keyline K1 of FIG. 1A, the first keyline 220 of FIG. 2 is shown as being coupled to an inner keyring 212 of the key 210.

The second keyline 230 is coupled to the outer keyring 214 of the key 210. There is also an extension 230A from the second keyline 230 which couples to a reference voltage (ground). Like keyline K2 of FIG. 1A, the extension 230A of FIG. 2 couples the outer ring 214 to a reference voltage (ground). For user input via the traditional key, when the user depresses the inner keyring 212 a contact is made between the inner keyring 212 and the outer keyring 214, which closes the circuit and provides a ground reference via the extension 230A to the baseband feed that is the first keyline 220. Together the first keyline 220, the second keyline 230 through its grounded extension 230A and the key 210 may be considered to be a data input device arrangement since they input data in the form of a user's key depression input.

There are also two serial decoupling elements along the first keyline 220 at FIG. 2 which may be considered generally as an electrical circuit. A cellular decoupling element 240A and a non-cellular decoupling element 250A are serially disposed along the first keyline 220 between the key 210 and the baseband processor 260. The FIG. 2 embodiment also includes a cellular decoupling element 240B and a non-cellular decoupling element 250B serially disposed along the second keyline extension 230A between the key 210 and the reference voltage (ground). In other embodiments, such as where the antenna is shorted and if the antenna is designed to be resonant in a non-cellular frequency band, at least the non-cellular decoupling element 250B along the keyline extension 230A may not be included. In other embodiments, such as where the antenna is shorted and if the antenna is designed to be resonant in a cellular frequency band, at least the cellular decoupling element 240B along the keyline extension 230A may not be included. The antenna may require a short circuit to ground coupled to the antenna feed in the cases where the antenna type is, for example, an inverted-F antenna (IFA) or a planar inverted-F antenna (PIFA).

If the second keyline 230 is configured as a Bluetooth (non-cellular) antenna, then the non-cellular decoupling element 250A along the first keyline 220 may be considered an electrically conductive component that decouples the data input device arrangement of key 210, first keyline 220, and grounded second keyline extension 230A to provide an antenna. In this case the antenna is provided by the second keyline 230 and the outer keyring 214 being the actual antenna radiator element.

However, due to close electromagnetic capacitive coupling between the inner keyring 212 and the outer keyring 214, in an embodiment at least a portion of the first keyline 220 may also become part of the antenna, and any conductive part from the inner keyring 212 to the decoupling component which decouples the antenna operational frequencies, in this example the non-cellular decoupling component 250A, may be considered to be part of the antenna. The close electromagnetic coupling may be intentionally designed by the designer of the apparatus such that the capacitance between the inner keyring 212 and the outer keyring 214 is a predetermined series capacitance calculated as part of the total electrical length of the antenna. This may provide a further advantage in shortening the electrical length of the antenna for a given physical length of the antenna provided by the inner keyring 212, outer keyring 214, and keylines 220, 230 such that the operational resonant frequency of the antenna may be increased. Note that for the case that the antenna radiating element is non-cellular as in this example, the specific locations of the non-cellular decoupling components 250A, 250B may also be disposed so as to define a total electrical length of the antenna. Whether or not there is capacitive coupling, at the moment the key 210 is depressed by the user the inner keyring 212 and outer keyring 214 are in electrical contact and so at that moment the antenna radiating element is extended along a portion of the first keyline 220.

The second keyline 230 is also tapped off at an antenna feed 232 which interfaces to the actual Bluetooth radio (not shown), and may additionally have matching circuitry (not shown) disposed between the Bluetooth radio and the antenna feed 232. In a variation of the FIG. 2 embodiment the first keyline 220 can connect to the outer keyring 214 and the second keyline 230 can connect to the inner keyring 212, but the illustrated embodiment gives the advantage that the larger open end of the outer keyring 214 gives better radiation properties generally. Note that these better radiation properties are present regardless of which keyline 220, 230 goes to the outer keyring 214 for embodiments as above in which the designer relies on capacitive coupling between inner 212 and outer 214 rings of the key 210.

In an example embodiment, either or both of the decoupling elements 240A, 250A along the first keyline 220 may be embodied as an impedance, a coil, or an inductive component in series with a conductive capacitance to create a high impedance at a band of operational frequencies. These are particularly configured such that the frequency band at which impedance is high enables the cellular or non-cellular frequency band needed to provide the antenna. This high impedance is configured to provide a stop band such that RF signals within a predetermined frequency band are prevented from passing the high impedance decoupling elements 240A, 250A through to the baseband circuitry 260. In various embodiments the decoupling elements 240B, 250B along the second keyline extension 230A may be identical to those disposed along the first keyline 220 since it is typical to isolate the BB processor 260 via line 220 and the ground via line 230A from the same RF bands (one non-limiting exception being for a shorted antenna as noted above).

As can be appreciated, the FIG. 2 embodiment can be implemented once in a mobile terminal or multiple times across multiple keys and keylines. FIG. 2 shows that embodiments of the invention enables the keys and the keylines to be a part of the antenna, and other examples below show that such an arrangement can be used for antenna purposes even if a keyline is not directly an antenna resonator element. The additional decoupling of the keys/keylines for the specified frequency band of interest for the antenna being implemented enables the designer greater flexibility in antenna placement while still being able to meet antenna performance metrics.

Figure 3:
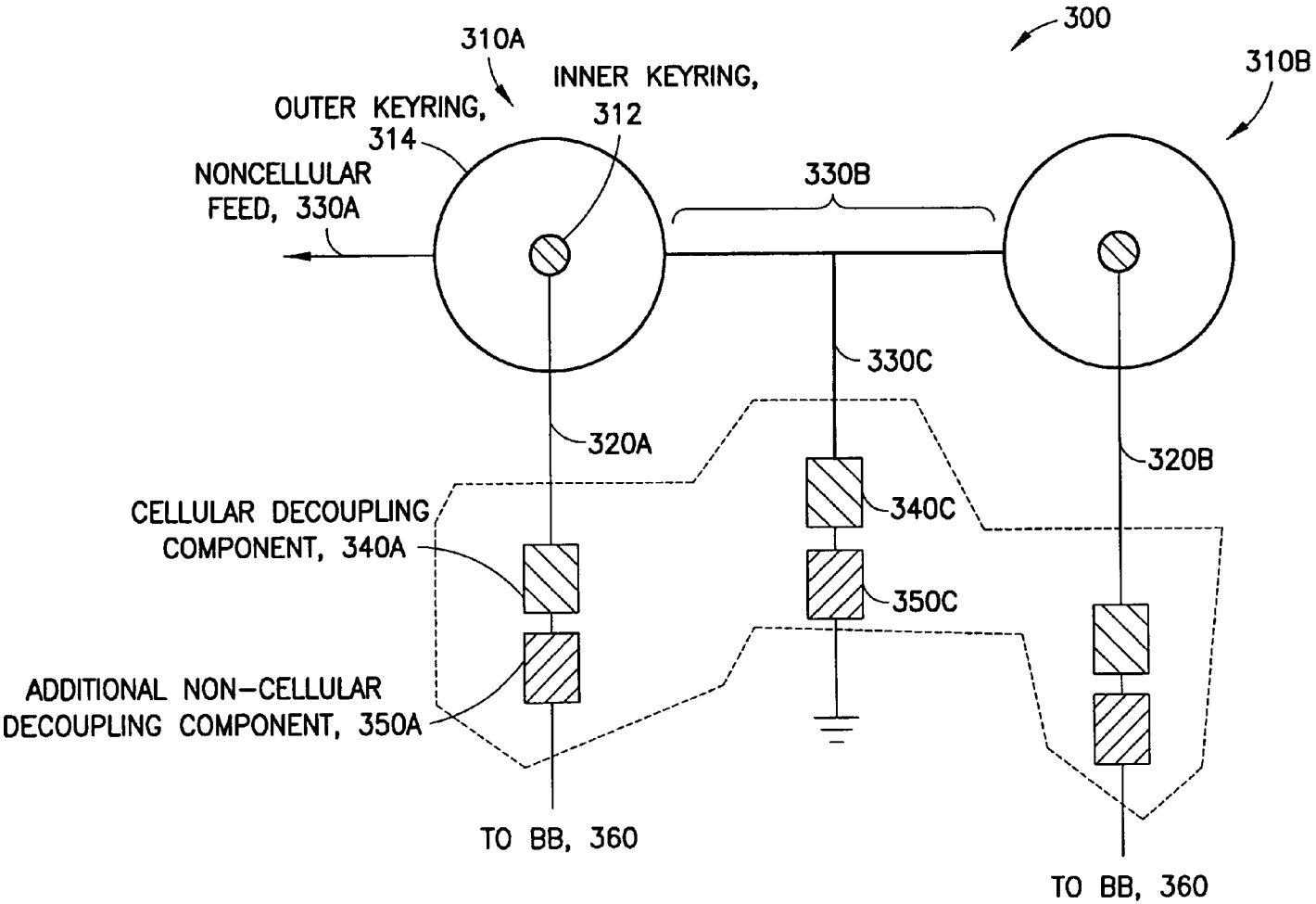
FIG. 3 is a schematic diagram similar to FIG. 2 but with two interconnected keys, according to an embodiment of the invention.

FIG. 3 is similar to FIG. 2 but with two interconnected keys, according to an example embodiment of the invention. The apparatus 300 has a first user input key 310A and a second user input key 310B which are interconnected with a portion 330B of the second keyline 330 which is shown as the combined portions 330A, 330B and 330C. Extending from the inner keyring 312 of the first key 310A there is a first keyline 320A on which are serially disposed a cellular decoupling element 340A and a non-cellular decoupling element 350A enroute to a baseband processor 360.

Extending from the inner keyring of the second key 310B there is a second keyline 320B on which are serially disposed a cellular decoupling element 340B and a non-cellular decoupling element 350B, also enroute to the baseband processor 360. There is also an extension 330C of the second keyline 330 which taps into the connector, or portion 330B of the second keyline 330 which runs between the outer keyrings of the first 310A and second 310B keys. A cellular decoupling element 340C in series with a non-cellular decoupling element 350C are disposed along the extension 330C, with the non-cellular decoupling component 350C, in this example, being coupled to ground to provide a DC ground for the key operation and a RF ground for the decoupling components 340C, 350C.

Each of the cellular decoupling elements 340A-C exhibit high impedance to the same frequency band. Each of the non-cellular decoupling elements 350A-C exhibit high impedance to the same frequency band, which in this case is the band at which the second keyline 330 is resonant. In this example embodiment the portion 330A of the second keyline 330 extending from the outer keyring 314 of the first key 310A feeds to a Bluetooth radio transceiver (or other radio receiver or transmitter or receiver). The location of these decoupling elements 340A-C, 350A-C is close to the keys in an embodiment, but they may be specifically located in alternative locations to get the best antenna and RF properties.

Figure 4:
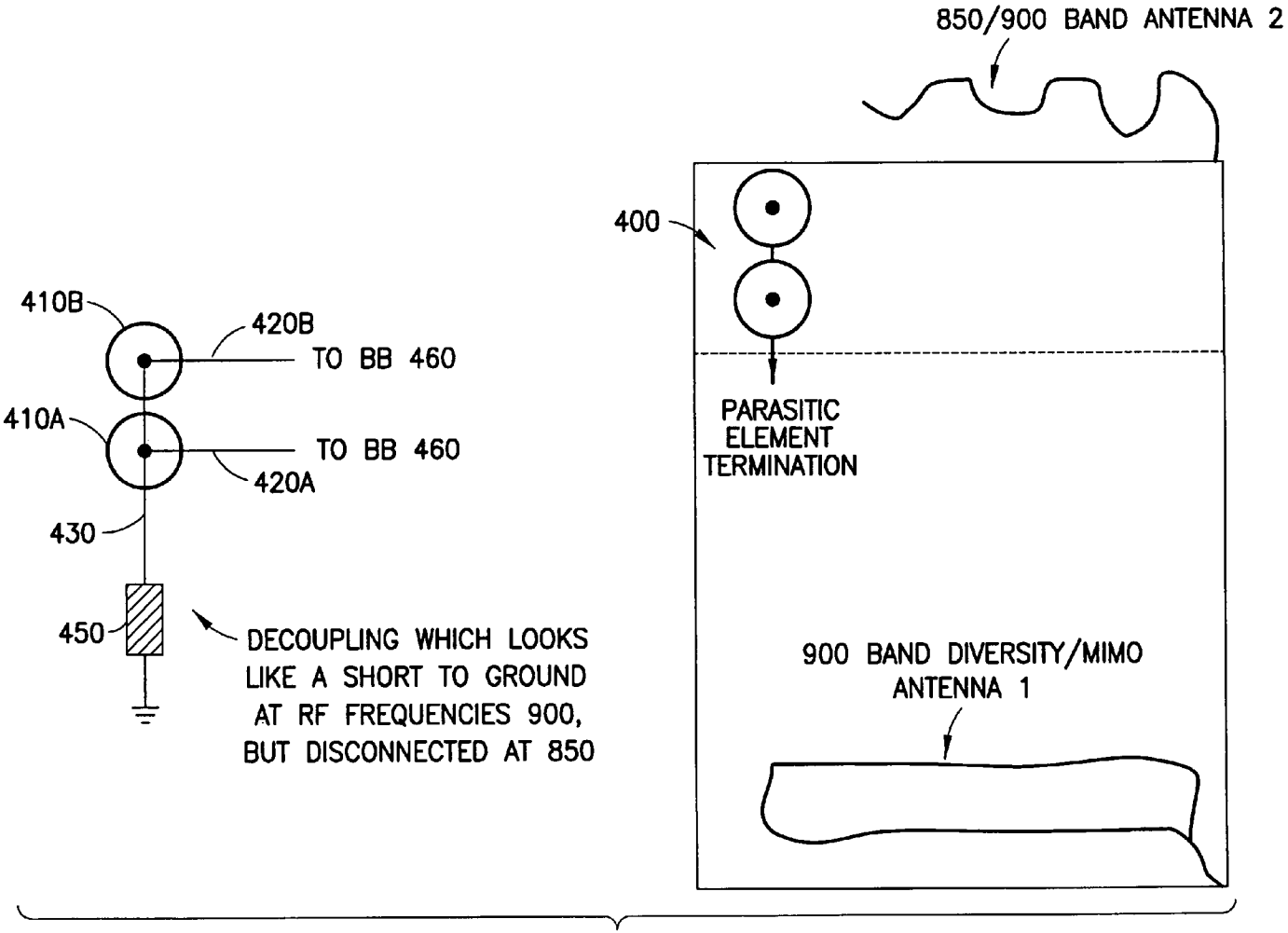
FIG. 4 is a schematic diagram similar to FIG. 3 but showing an embodiment in which the antenna is provided by the second keyline operating as a parasitic element termination, according to an embodiment of the invention.

FIG. 4 is an example embodiment in which an antenna is provided by the second keyline 430 operating as a parasitic antenna element 400. Specifically a portion of the second keyline 430 coupled to the outer keyring 410A has a decoupling element 450 disposed in series, such as a reactive component (capacitor and/or inductor) which looks like a short to ground at RF, thereby terminating a band of frequencies to ground, the band of frequencies received by the parasitic antenna element 400 as coupled from the antenna 2 which would exist without the decoupling element 450. In the case where the decoupling element 450 is an inductor this may also be configured to provide a DC ground for the key operation.

The inset at the left of FIG. 4 gives details of the data input device arrangement made of the keys 410A, 410B and the second keyline 430 as described above. First keylines 420A, 420B to the inner rings are similar to those shown for FIG. 3, showing the connection to the baseband processor 460.

The overview at the right side of FIG. 4 shows that the overall mobile terminal apparatus 400 has a first antenna 1 and a second antenna 2 depicted as the radiating component of those two antennas. Assume antenna 1 is a cellular antenna operating at 900 MHz but in this example is a diversity and/or a MIMO (multiple input multiple output) antenna, and antenna 2 is another cellular antenna operating at 850 and 900 MHz bands. The parasitic antenna element 400 comprising the decoupling element 450 parasitically couples radio frequencies from the nearer antenna 2 with the keys 410A, 410B. As stated above the radio frequencies which are coupled via the decoupling element 450 to ground effectively help to improve RF isolation between the antenna 1 and the antenna 2. In the above example embodiment the 900 MHz band is coupled to ground whereas the 850 MHz band is not, and this improves the operation of both antenna 1 and antenna 2 at 900 MHz. This can be implemented for each key or key pair of the entire keymat to prevent adverse RF coupling. Further parasitic antenna elements operating at the same or different frequencies may be disposed at a different key or plurality of keys anywhere within the overall apparatus.

Figure 5A:
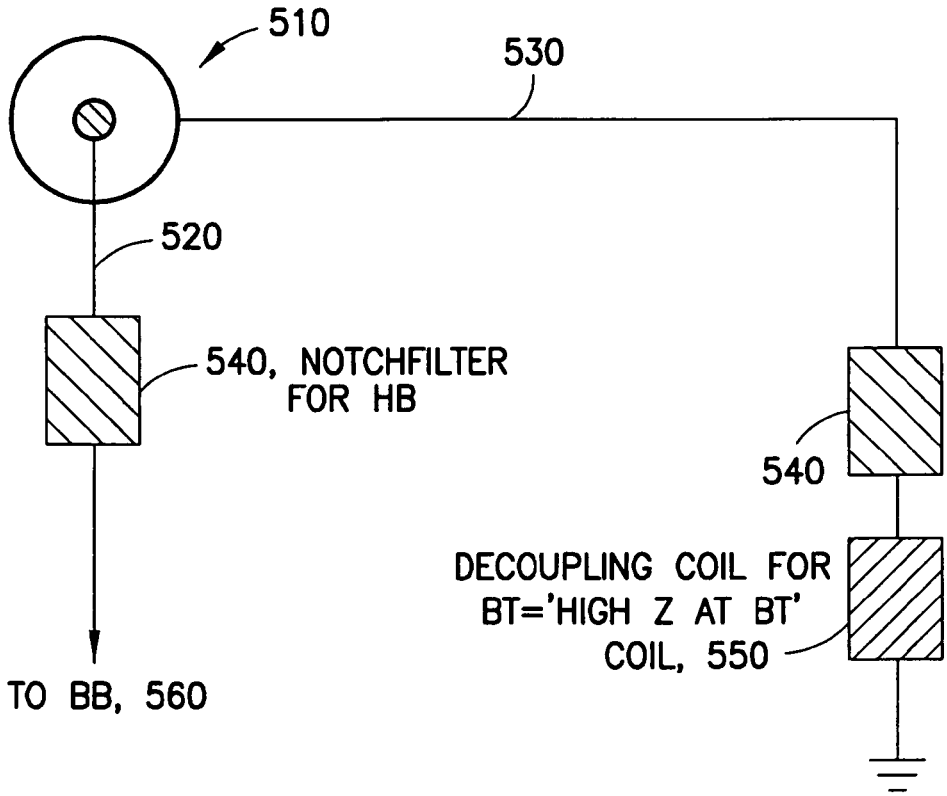
FIG. 5A illustrates a preliminary arrangement from which follow the schematic diagrams FIGS. 5B-C, two exemplary embodiments of the invention which employ a notch filter in the antenna radiating element.
Figure 5B:
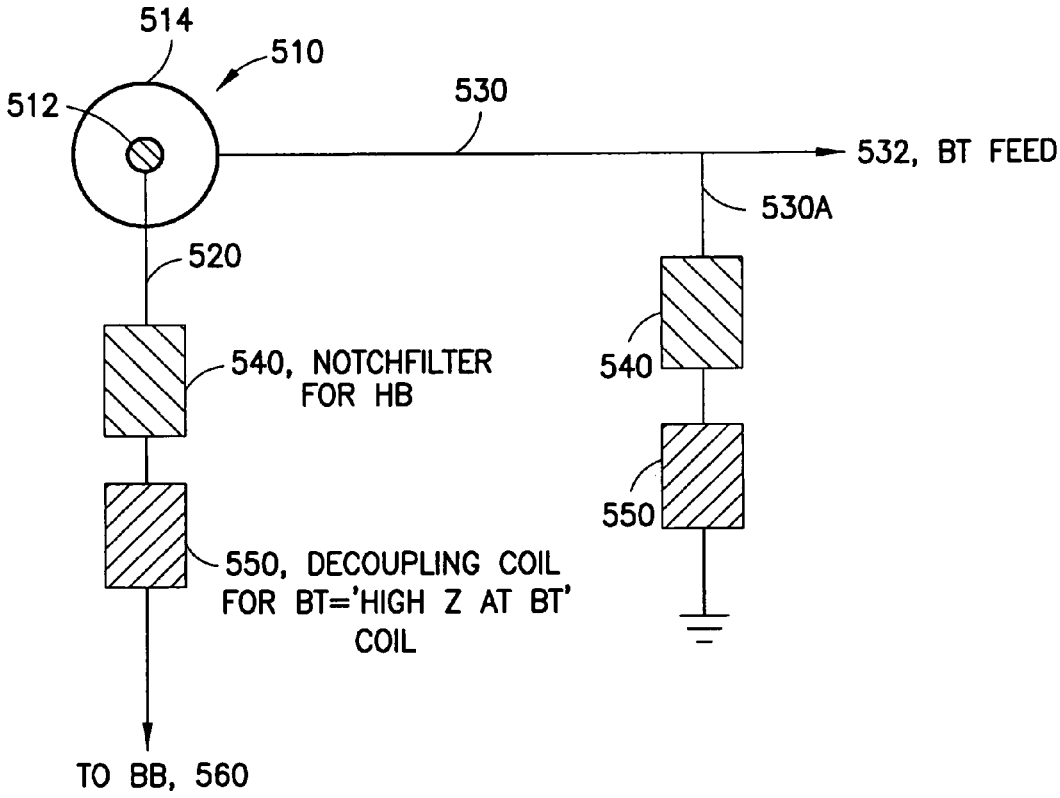
Figure 5C:
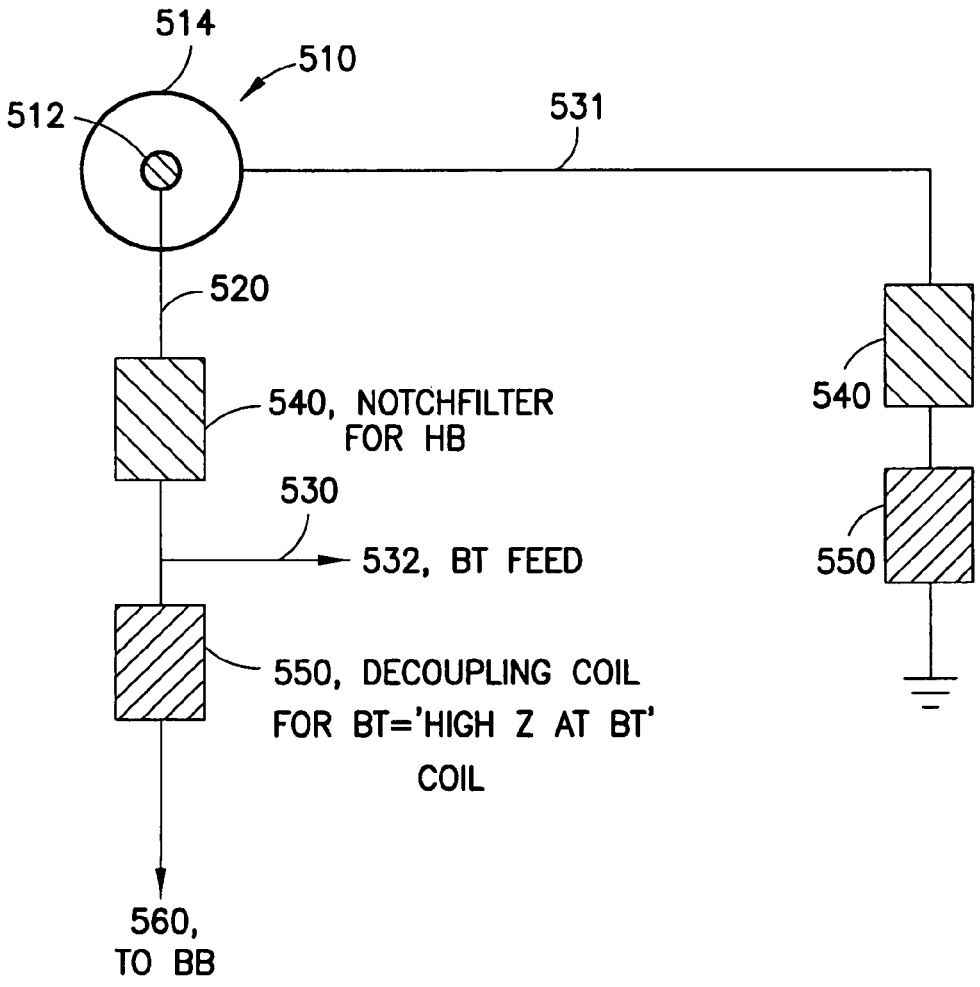

FIG. 5A illustrates a preliminary arrangement used to describe the exemplary embodiments of FIGS. 5B-C which employ a notch filter in the antenna radiating element. Conventionally, keys are decoupled with a coil (inductive reactance) which presents a high impedance to the band where the key must be RF disconnected. This can be equivalent to and replaced with a notch filter 540 along the first keyline 520 as shown at FIG. 5A. From there is derived the two exemplary embodiments of the invention at FIGS. 5B-C.

The FIG. 5B example embodiment finds the first keyline 520 from the key 510 having in series the notch filter 540 for the cellular high frequency band (HB) and the decoupling coil 550 providing a high impedance for blocking the Bluetooth band. In the FIG. 5B embodiment the second keyline 530 is from the key 510 itself, and so the antenna radiator element is along the second keyline 530 and includes at least the outer keyring of that key 510. When the key 510 is depressed (or when the inner and outer rings are inductively coupled as noted above) the antenna radiating element then extends along the first keyline 520 through the notch filter 540 and terminates at the decoupling coil 550. This is because when the key is depressed the inner keyring 512 and outer keyring 514 make a galvanic connection and therefore extend the antenna radiating element comprising the second keyline 530 and the outer keyring 514 by adding via the inner keyring 512 the first keyline 520 to the antenna radiating element. When the key 510 is not depressed the antenna radiating element may still be extended due to the electromagnetic capacitive coupling between the inner keyring 512 and outer keyring 514, as discussed in previous example embodiments, In this scenario the capacitance and the keyline physical length add to the overall antenna radiating element length, that is the electrical and physical lengths. The transmitted or received signal resonant on the second keyline 530 at FIG. 5B feeds to or from a Bluetooth transceiver (not shown) at antenna feed 532. Reference voltage for user data input purposes when the key 510 is depressed is along the extension 530A, similar to FIG. 2.

The first part of the FIG. 5C example embodiment is similar to that of FIG. 5B: the first keyline 520 from the key 510 has disposed along it in series the notch filter 540 for the cellular high frequency band (HB) and the decoupling coil 550 for blocking the Bluetooth band. And the reference voltage to enable user inputs via the key 510 is along a grounded keyline 531. But in the FIG. 5C embodiment the second keyline 530 couples to the first keyline 520, and taps into the second keyline 530 between the notch filter 540 and the decoupling coil 550. In this embodiment the antenna radiator element is along the second keyline 530 and extends through the notch filter 540 and then to the inner keyring 512 of the key 510 via the first keyline 520, then via the outer keyring 514 along the keyline 531 and finally through a second notch filter 540. The antenna radiating element terminates at the non-grounded terminal of the decoupling coil 550 where the decoupling coil 550 provides a ground voltage reference for DC and a RF ground reference for RF signals which are not presented with a high impedance at RF frequencies, as filtered by the decoupling coil 550 and notch filter 540. This better exploits the high band (cellular) properties of the notch filter 540 and achieves a better isolation between the Bluetooth band on the second keyline 530 and the high band frequency.

Figure 6A:
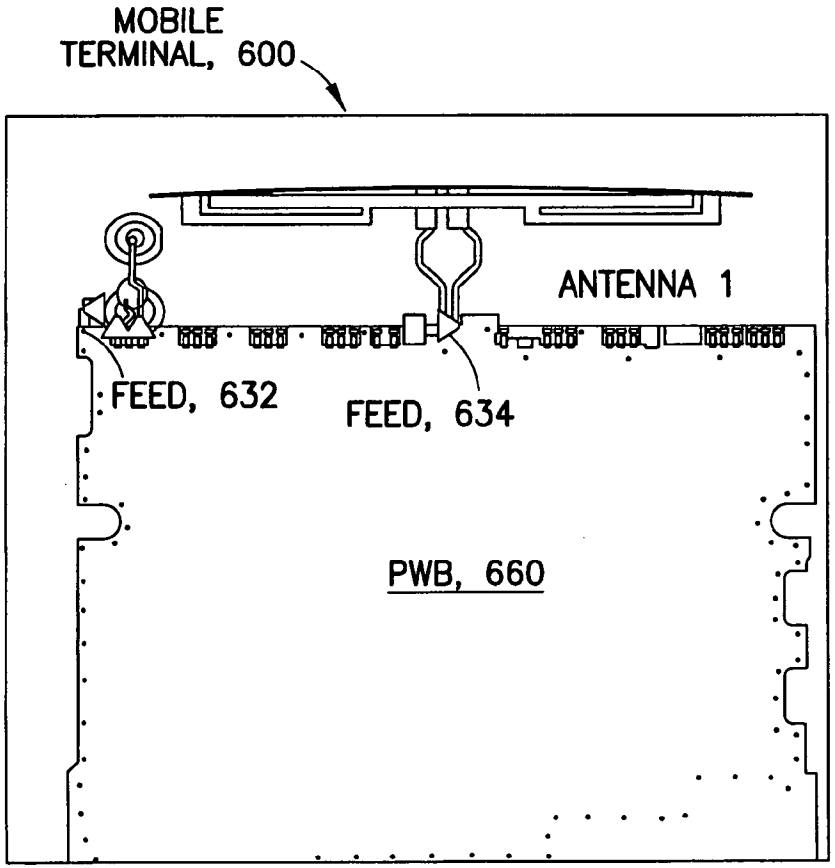
FIG. 6A is a perspective overview of a host apparatus and FIG. 6B is an expended inset view of 6A showing an embodiment of the invention with more particularity.

FIG. 6A illustrates in perspective a broader overview of an example embodiment of the data input device arrangement in the context of a printed wiring board PWB 660 of a mobile terminal apparatus 600. There is an inset portion of FIG. 6A expanded at FIG. 6B. In general, FIG. 6A illustrates a first antenna, in this example embodiment it is a cellular antenna, Antenna 1, that is coupled to the PWB 660 at an antenna feed 634, and a Bluetooth or secondary antenna radiating element, Antenna 2, that is in part the second keyline 630 of the data input device arrangement. The second antenna, Antenna 2, is coupled to the PWB 660 at an antenna feed 632 in the top left corner of the PWB 660 as illustrated in FIG. 6A.

Figure 6B:
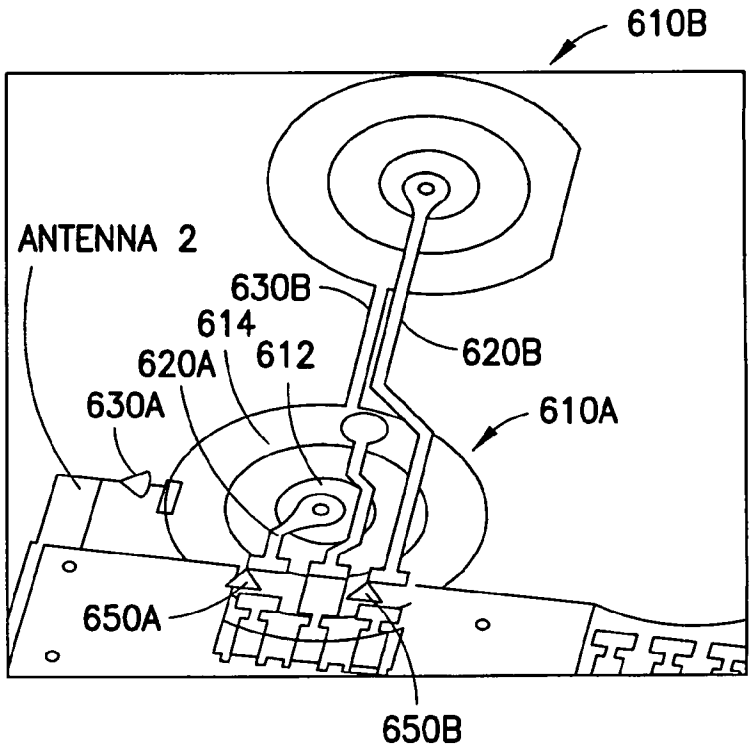

Referring now to the inset at FIG. 6B, the data input device arrangement is similar to that shown at FIG. 3 but the more detailed view of FIG. 6B shows the more particularized interconnections. Specifically, there is a first key 610A having an inner keyring 612 and an outer keyring 614. The outer keyring 614 of the first key 610A is connected to the outer keyring of the second key 610B via a portion 630B of the second keyline 630 (shown as 630A and 630B). The inner keyring 612 of the first key 610A is connected to the PWB 660 by a first keyline 620A of the first key 610A and a first non-cellular decoupling element 650A. The inner keyring of the second key 610B is connected to the PWB 660 via a first keyline 620B of the second key 610B and a second non-cellular decoupling element 650B. Along the left side of FIG. 6B it is seen that a portion 630A of the second keyline 630 extends from the outer keyring 614 of the first key 610A, that portion 630A providing the feed to the Bluetooth radiating element, Antenna 2. The feed provided by that portion 630A of the second keyline 630 is further coupled to the Bluetooth transceiver (not shown in FIGS. 6A and 6B) in this example embodiment, but in other embodiments it may be coupled to a receiver only, a transmitter only, or a different transceiver operating at different frequency bands. The Bluetooth transceiver and other radio frequency circuitry is implemented on the PWB 660 in this example embodiment, but in other embodiments RF radio transceivers, receivers, transmitters, RF integrated circuits and circuitry may be disposed on flexi circuits or other substrates used in the art for such purposes.

Figures 2, 6C:
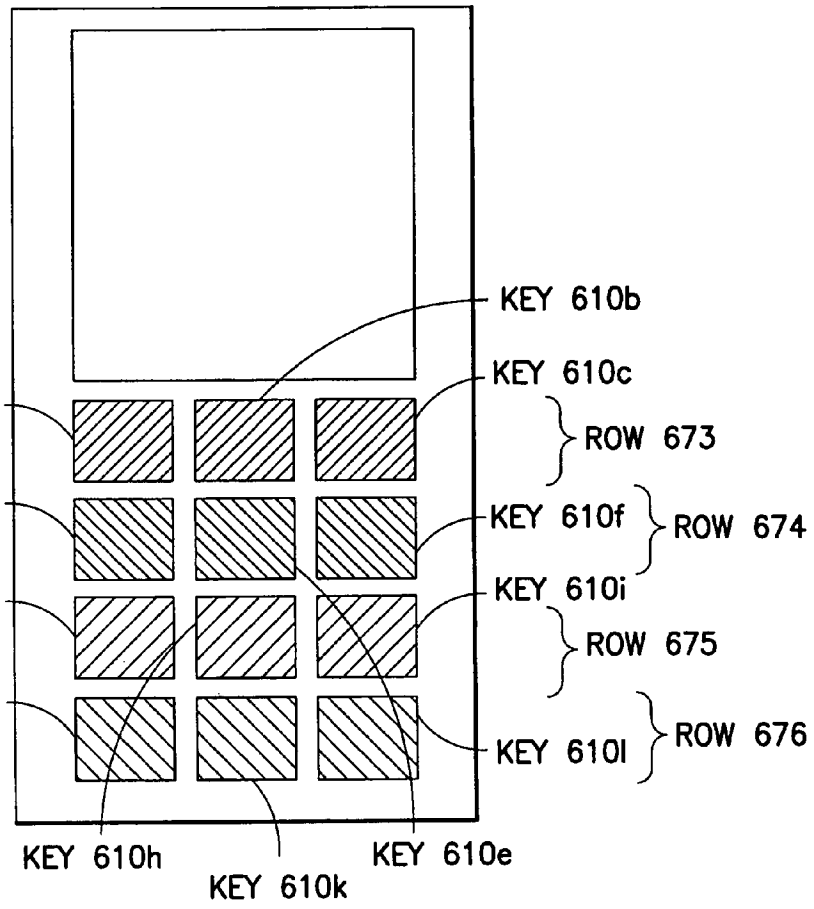
Figures 1, 6C:
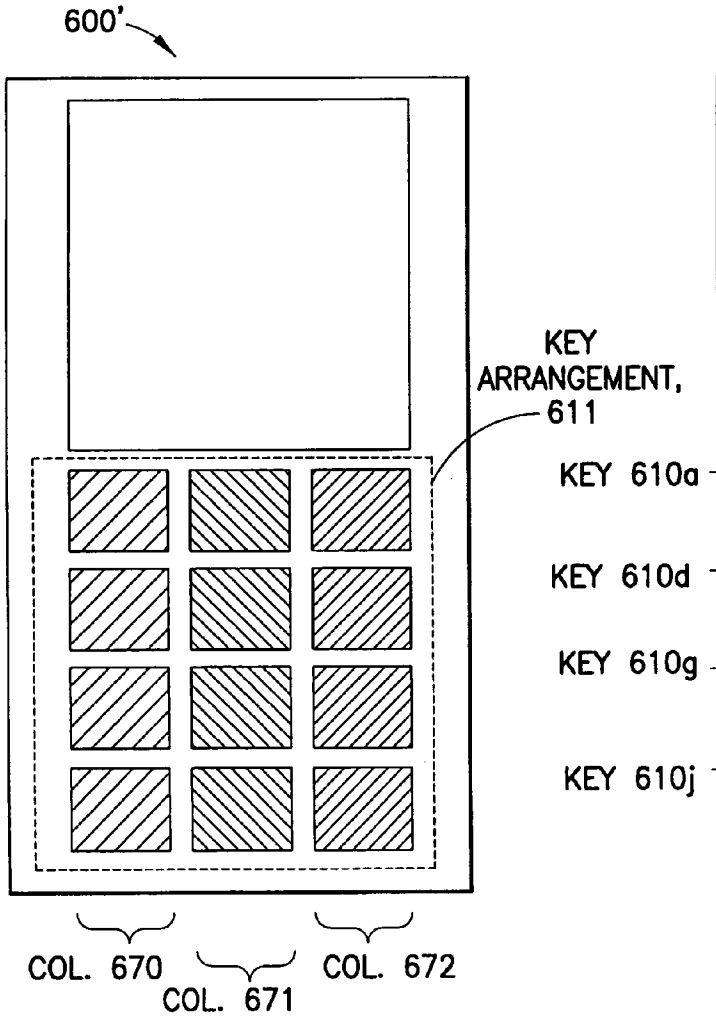
Figures 3, 6C:
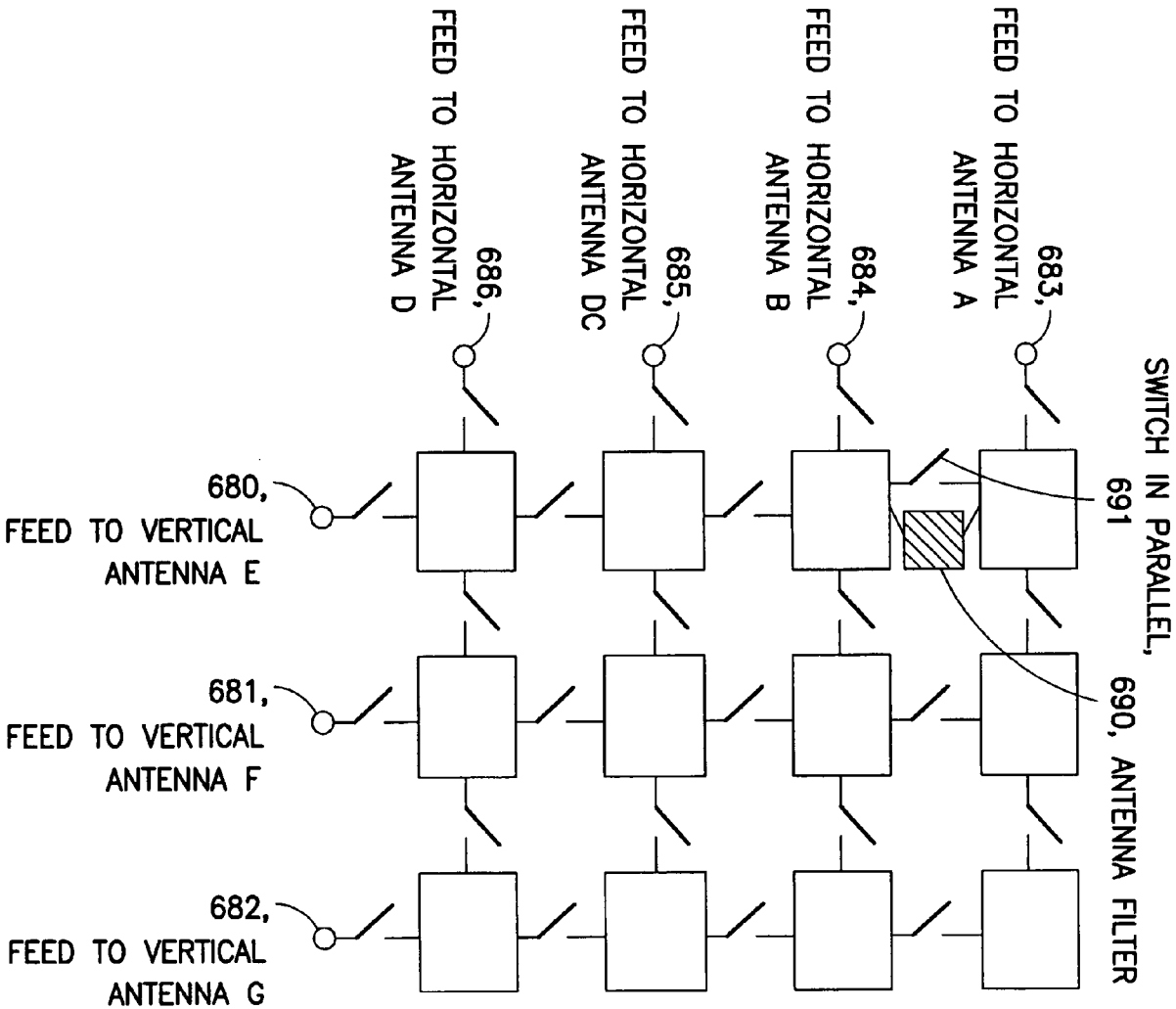

In a further example embodiment of a host apparatus 600' shown at FIGS. 6C-1 through 6C-3, a key arrangement 611 similar to that as used in conventional portable electronic devices, for example mobile phones or PDAs, comprising an array of twelve alphanumeric keys may be configured as an antenna array. The key arrangement or matrix 611 may be described as comprising: a first row 673 of keys 610*a*, 610*b* and 610*c*; a second row 674 of keys 610*d*, 610*e*, and 610*f*; a third row 675 of keys 610*g*, 610*h* and 610*i*; and a fourth row 676 of keys 610*j*, 610*k* and 610*l* as illustrated in FIG. 6C-2. Similarly the key matrix 611 could be described as comprising three columns of keys: a first column 670 of keys 610*a*, 610*d*, 610*g*, and 610*j*; a second column 671 of keys 610*b*, 610*e*, 610*h* and 610*k*; and a third column 672 of keys 610*c*, 610*f*, 610*i* and 610*l* as illustrated in FIGS. 6C-1 and 6C-2.

The antenna array 611 may be such that a three by four key arrangement, comprising three keys horizontally and four keys vertically, may provide up to three vertical antennas in an array as illustrated in FIG. 6C-1. A similar arrangement of multiple antennas in an array may be provided if the four rows of three keys are used instead to provide up to four horizontal antennas in the array as illustrated in FIG. 6C-2.

A further example embodiment is illustrated in FIG. 6C-3 where both the horizontal and vertical arrays described in FIGS. 6C-1 and 6C-2 are combined by switching between horizontal and vertical antenna elements by an antenna selection processor (not illustrated). There are four horizontal antenna feeds 683, 684, 685 and 686 coupled to respective keys 610*a*, 610*d*, 610*g* and 610*j*; and a further three vertical antenna feeds 680, 681 and 682 coupled to respective keys 610*j*, 610*k* and 610*l*. The two antenna feeds 686, 680 coupled to key 610*j* may be combined into a single feed in some embodiments. An antenna filter 690 may be present between each key and disposed on a keyline between each key pair in the matrix of keys. Only one filter 690 is shown in FIG. 6C-3 for clarity, but in an exemplary embodiment there would be one filter 690 in parallel with each switch 691. This prevents each specific key and associated keylines from being used as an antenna radiating element until a switch 691 disposed in parallel with the filter 690 is actuated whereby the RF signals are then allowed to pass either from an antenna feed or from a first key to a second key, the filter and switch disposed between the first 610*a* and second 610*d* keys in this example.

As can be appreciated from the above exemplary but non-limiting embodiments, one technical effect of certain embodiments of the invention is that the portable electronic host device no longer needs a separate keypad and antenna, as certain embodiments of this invention can combine the functions of both into a single part and thereby improving the volume requirements in the host device. Another technical effect of certain embodiments is that performance degradation is improved for the inventive antenna, since such an antenna is now the same component as the keypad arrangement. Another technical effect is that the combined functions of data entry key and antenna enables more of the mobile terminal host device to be utilized for the antenna purpose. This is particularly useful in light of product development trends which tend toward more numerous antennas and increasingly scarce physical space in which to dispose them.

Figure 7:
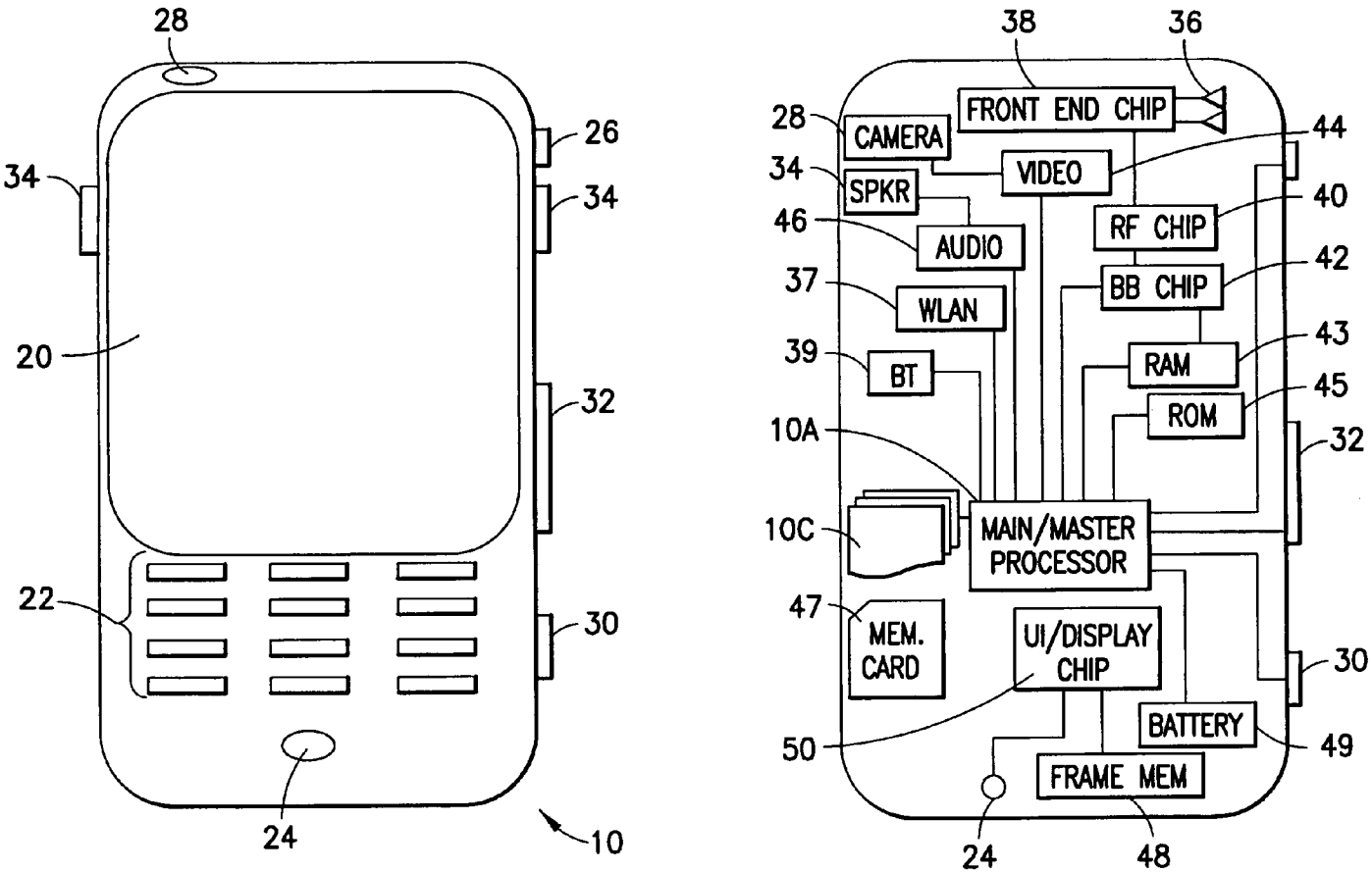
FIG. 7 is a schematic diagram in plan view (left) and sectional view (right) of a mobile terminal host device in which exemplary embodiments of the invention might be disposed.

For completeness, an example mobile terminal host device, also termed a user equipment UE, is shown in both plan view (left) and sectional view (right) at FIG. 7. The UE 10 has a graphical display interface 20 and a user interface 22 illustrated as a keypad but understood as also encompassing a QWERTY keyboard or touch-screen technology at the graphical display interface 20. In any case the UE 10 has at least one physical key or button by which a user enters an input by physical depression or deformation of the key.

Located below the keypad 22 is a microphone 24. A power actuator 26 controls the device being turned on and off by the user. The example UE 10 may have a camera 28 which is controlled by a shutter actuator 30 and optionally by a zoom actuator 32 which may alternatively function as a volume adjustment for the speaker(s) 34 when the camera 28 is not in an active mode.

Within the sectional view of FIG. 7 are seen multiple transmit/receive antennas 36 that are typically used for cellular communication and in the example embodiments detailed above are separate and distinct from the secondary radio antennas (for example Bluetooth, GPS, WLAN, RFID) used by example in the embodiments shown in detail above. Note that the invention is not limited only to secondary radio antennas. These cellular antennas 36 may be multi-band for use with multiple cellular radios in the UE, or single band for a single cellular radio using MIMO transmission techniques. In an embodiment the power adjusting function of the power chip 38 noted below may be incorporated within the RF chip 40 (such as by amplifiers and related circuitry), in which case the antennas 36 interface to the RF chip 40 directly. The UE 10 may have only one cellular antenna 36. The operable ground plane for the antennas 36 may vary greatly depending on antenna type and placement, typically disposed on one or more layers of one or more printed wiring boards within the UE 10. The operable ground plane may also comprise parts of the portable electronic device which are not printed wiring boards, for example, covers, shielding cans, batteries, displays and the like.

The RF Tx/Front-End chip 38 may control power amplification, if a transmitter is required within the RF Tx/Front-End chip 38, on the channels being transmitted and/or across the cellular antennas 36 and amplifies the received signals in a receiver, if a receiver is required within the RF Tx/Front-End chip 38. The RF Tx/Front-End chip 38 outputs the amplified received signal to the radio-frequency (RF) chip 40 which demodulates and downconverts the various signals for baseband processing. The RF Tx/Front-End chip 38 and the RF chip 40 may be combined in a single chip or integrated circuit (IC), or they may be separate as described in this example embodiment, further they may both require discrete support circuitry outside of the respective integrated circuits for RF, DC and Baseband functions. The baseband (BB) chip 42 detects the signal which is then converted to a bit-stream and finally decoded. Similar processing occurs in reverse for signals transmitted from the apparatus 10.

The secondary radios may use some or all of the processing functionality of the RF chip 40, and/or the baseband chip 42. There may be an image/video processor 44 which encodes and decodes the various image frames from the camera and to the display 20. A separate audio processor 46 may also be present controlling signals to and from the speakers 34 and the microphone 24. The graphical display interface 20 is refreshed from a frame memory 48 as controlled by a user interface chip 50 which may process signals to and from the graphical display interface 20 and/or additionally process user data inputs from the keypad 22 and elsewhere.

Throughout the apparatus are various memories such as random access memory RAM 43, read only memory ROM 45, and in some embodiments removable memory such as the illustrated memory card 47 on which various programs of computer readable instructions are stored. All of these components within the UE 10 are normally powered by a portable power supply such as a battery 49.

The aforesaid processors 38, 40, 42, 44, 46, 50, if embodied as separate entities in a UE 10, may operate in a slave relationship to the main processor 12, which may then be in a master relationship to them. Any or all of these various processors of FIG. 7 access one or more of the various memories, which may be on-chip with the processor or separate therefrom.

Note that the various processors or chips (e.g., 38, 40, 42, etc.) that were described above may be combined into a fewer number than described and, in a most compact case, may all be embodied physically within a single processing chip.

Figure 8:
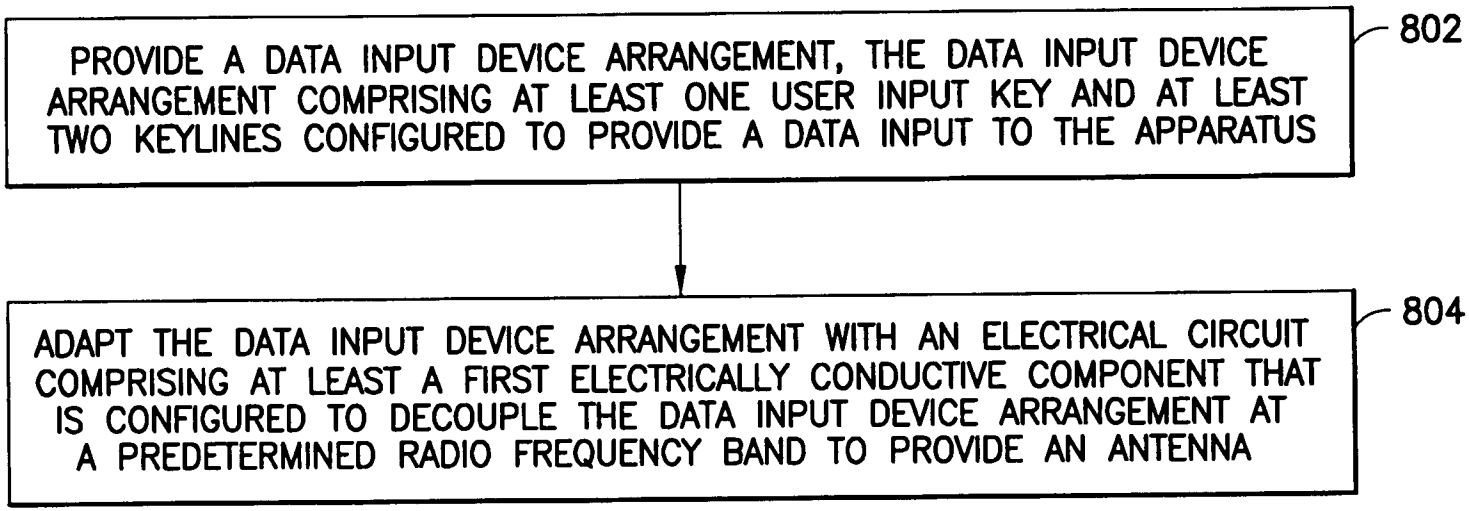
FIG. 8 is a logic flow diagram that illustrates the operation of a method, and a result of execution of computer program instructions embodied on a computer readable memory, for making one or more keys with the dual function of data input and antenna in accordance with an example embodiment of the invention.

FIG. 8 is a logic flow diagram that illustrates the operation of a method for making an electronic apparatus in accordance with the example embodiments of this invention. At block 810 there is provided a data input device arrangement that comprises at least one user input key and at least two keylines configured to provide a data input to the apparatus. By example this might be the data input device arrangement as shown at FIG. 1A. At block 820 then the data input device arrangement is adapted with an electrical circuit comprising at least a first electrically conductive component that is configured to decouple the data input device arrangement at a predetermined radio frequency band to provide an antenna. By example this may be any of the non-cellular decouplers shown variously at FIGS. 2 through 6.

In a particular embodiment such as that shown at FIG. 2 the second keyline provides an antenna radiating element when the first electrically conductive component decouples the data input device. In another particular embodiment such as that shown at FIG. 4 the second keyline provides an antenna parasitic short to ground when the first electrically conductive component decouples the data input device. In any of the above embodiments the predetermined frequency band(s) is/are operational frequencies of the antenna that the data input device provides, such as for example non-cellular bands but also cellular bands in other embodiments.

The various blocks shown in FIG. 8 may be viewed as method blocks, and/or as operations that result from operation of computer program code which runs manufacturing equipment, and/or as a plurality of coupled logic circuit elements constructed to carry out the associated function(s).

Various modifications and adaptations to the foregoing example embodiments of this invention may become apparent to those skilled in the relevant arts in view of the foregoing description, when read in conjunction with the accompanying drawings. However, any and all modifications will still fall within the scope of the non-limiting and example embodiments of this invention.

It should be noted that the terms "connected," "coupled," or any variant thereof, mean any connection or coupling, either direct or indirect, between two or more elements, and may encompass the presence of one or more intermediate elements between two elements that are "connected" or "coupled" together. The coupling or connection between the elements can be physical, logical, or a combination thereof. As employed herein two elements may be considered to be "connected" or "coupled" together by the use of one or more wires, cables and/or printed electrical connections, as well as by the use of electromagnetic energy, such as electromagnetic energy having wavelengths in the radio frequency region, the microwave region and the optical (both visible and invisible) region, as several non-limiting and non-exhaustive examples.

Furthermore, some of the features of the various non-limiting and example embodiments of this invention may be used to advantage without the corresponding use of other features. As such, the foregoing description should be considered as merely illustrative of the principles, teachings and example embodiments of this invention, and not in limitation thereof.

I claim:

1. An apparatus comprising:

a data input device arrangement, the data input device arrangement comprising at least one user input key and at least two keylines configured to provide a data input to the apparatus, and an electrical circuit, wherein the electrical circuit comprises at least a first electrically conductive component configured to decouple the data input device arrangement at a predetermined radio frequency band to cause at least one of the keylines to operate as an antenna radiating element in the predetermined radio frequency band, and wherein one of the keylines comprise an antenna feed.

2. The apparatus according to claim 1, in which the apparatus comprises a portable electronic device.

3. The apparatus according to claim 1, in which the first electrically conductive component comprises a cellular decoupling element and a non-cellular decoupling element serially disposed along at least one of the at least two keylines, wherein the cellular and the non-cellular decoupling elements are configured to be coupled to a ground to provide a direct current ground for the at least one user input key and provide a radio frequency ground for the decoupling elements.

4. The apparatus according to claim 1, in which the at least one of the keylines operate as a parasitic antenna element further comprising the antenna feed is configured to be coupled to ground when the first electrically conductive component decouples the data input device arrangement.

5. The apparatus according to claim 1, in which the first electrically conductive component exhibits a high impedance at the predetermined radio frequency band.

6. The apparatus according to claim 1, in which the first electrically conductive component comprises a notch filter which passes the predetermined radio frequency band.

7. The apparatus according to claim 6, in which the notch filter is disposed along a first one of the at least two keylines and a second one of the at least two keylines extends from one of the at least one user input key.

8. The apparatus according to claim 6, in which a first one of the at least two keylines extends from one of the at least one user key, a second one of the at least two keylines extends from the first keyline, and the notch filter is disposed along the first keyline between the at least one user key and the second keyline.

9. The apparatus according to claim 1, in which the electrical circuit comprises a decoupling coil disposed along one of the at least two keylines in series with the first electrically conductive component.

10. The apparatus according to claim 9, in which the electrical circuit comprises a cellular decoupling coil and a non-cellular decoupling coil in series with one another along the said one of the at least two keylines.

11. The apparatus according to claim 1, in which the antenna feed is configured to be coupled to radio frequency circuitry.

12. The apparatus according to claim 1, in which the antenna feed is configured to be coupled to radio frequency circuitry and ground.

13. A method comprising:

providing a data input device arrangement, the data input device arrangement comprising at least one user input key and at least two keylines configured to provide a data input to an apparatus, and adapting the data input device arrangement with an electrical circuit comprising at least a first electrically conductive component that is configured to decouple the data input device arrangement at a predetermined radio frequency band to cause at least one of the keylines to operate as an antenna radiating element in the predetermined radio frequency band, wherein at least one of the keylines comprise an antenna feed.

14. The method according to claim 13, in which the apparatus comprises a portable electronic device.

15. The method according to claim 13, in which the first electrically conductive component comprises a cellular decoupling element and a non-cellular decoupling element serially disposed along at least one of the at least two keylines, wherein the cellular and the non-cellular decoupling elements are configured to be coupled to a ground to provide a direct current ground for the at least one user input key and provide a radio frequency ground for the decoupling elements.

16. The method according to claim 13, in which the at least one of the keylines operate as a parasitic antenna element further comprising the antenna feed is configured to be coupled to ground when the first electrically conductive component decouples the data input device.

17. The method according to claim 13, in which the first electrically conductive component exhibits a high impedance at the predetermined radio frequency band.

18. The method according to claim 13, in which the first electrically conductive component comprises a notch filter which passes the predetermined radio frequency band.

19. The method according to claim 18, in which adapting the data input device arrangement comprises disposing the notch filter along a first one of the at least two keylines, wherein a second one of the at least two keylines extends from one of the at least one user input key.

20. The method according to claim 18, in which a first one of the at least two keylines extends from the key, and a second one of the at least two keylines extends from the first keyline, and in which adapting the data input device arrangement comprises disposing the notch filter along the first keyline between the key and the second keyline.

21. The method according to claim 13, and in which adapting the data input device arrangement comprises disposing a decoupling coil along one of the keylines in series with the first electrically conductive component.

22. The method according to claim 21, in which the electrical circuit comprises a cellular decoupling coil and a non-cellular decoupling coil in series with one another along the said one of the keylines.

23. An apparatus comprising:

at least one processor; and at least one memory including computer program code, where the at least one memory and the computer program code are configured, with the at least one processor, to cause the apparatus to at least:

provide, with a data input device arrangement comprising at least one user input key and at least two keylines, a data input to the apparatus, and decouple, with at least a first electrically conductive component, the data input device arrangement at a predetermined radio frequency band causing at least one of the keylines to operate as an antenna in the predetermined radio frequency band, wherein at least one of the keylines comprise an antenna feed.

* * * * *